US009474984B1

(12) United States Patent
Yabe

(10) Patent No.: US 9,474,984 B1
(45) Date of Patent: Oct. 25, 2016

(54) COUPLED BALLOON

(71) Applicant: S.A.G. BALLOONS., LTD., Sumida-ku, Tokyo (JP)

(72) Inventor: Nobuhiko Yabe, Tokyo (JP)

(73) Assignee: S.A.G. BALLOONS., LTD., Tokyo (JP)

( * ) Notice: Subject to any disclaimer, the term of this patent is extended or adjusted under 35 U.S.C. 154(b) by 0 days.

(21) Appl. No.: 15/027,233

(22) PCT Filed: Sep. 11, 2015

(86) PCT No.: PCT/JP2015/075808
§ 371 (c)(1),
(2) Date: Apr. 4, 2016

(87) PCT Pub. No.: WO2016/056348
PCT Pub. Date: Apr. 14, 2016

(30) Foreign Application Priority Data

Oct. 10, 2014 (JP) ..... 2014-209074

(51) Int. Cl.
*A63H 27/10* (2006.01)
*A63H 3/06* (2006.01)

(52) U.S. Cl.
CPC ..... *A63H 27/10* (2013.01); *A63H 3/06* (2013.01); *A63H 2027/1075* (2013.01)

(58) Field of Classification Search
CPC ..... A63H 27/10; A63H 3/06; A63H 2027/1025; A63H 2027/1041; A63H 2027/1075
See application file for complete search history.

(56) References Cited

U.S. PATENT DOCUMENTS 1,485,577 A 3/1924 Witten
2,008,552 A * 7/1935 Jacobs ..... A63H 27/10 446/221
2,731,768 A * 1/1956 Harrowe ..... A63H 3/06 285/200
3,065,566 A * 11/1962 Sugimoto ..... A63H 3/06 446/221
3,358,398 A * 12/1967 Chalfin ..... G09F 7/06 40/214

(Continued)

FOREIGN PATENT DOCUMENTS

GB 2266847 A * 11/1993 ..... A63H 3/06
JP 05021998 U 3/1993

(Continued)

OTHER PUBLICATIONS

International Search Report (ISR) dated Dec. 1, 2015 issued in International Application No. PCT/JP2015/075808.

(Continued)

*Primary Examiner* — Gene Kim
*Assistant Examiner* — Alyssa Hylinski
(74) *Attorney, Agent, or Firm* — Holtz, Holtz & Volek PC

(57) ABSTRACT

A coupled balloon includes: a first balloon body, at least one second balloon body, through-holes formed in the balloon bodies via which the balloon bodies communicate with each other, and a double-sided bonding tape having a communication hole which is aligned with the through-holes, by which outward-surface-side peripheral edge portions of each of the through-holes are joined together. Inside of the balloon bodies include a heat seal layer, and outside thereof is formed by overlapping films configured from gas barrier layers. A valve for injecting a gas into one location on a peripheral edge of the first balloon body is interposed, and the peripheral edge other than an inner surface of the valve is thermally fused. A peripheral edge of the at least one second balloon body is thermally fused.

11 Claims, 6 Drawing Sheets

(56) References Cited

U.S. PATENT DOCUMENTS

| | | | | |
|---|---|---|---|---|
| 3,658,326 | A | 4/1972 | Fawick | |
| 4,267,662 | A * | 5/1981 | Gordy | A63H 33/06 446/121 |
| 4,629,182 | A | 12/1986 | Rader et al. | |
| 4,693,695 | A * | 9/1987 | Cheng | A63H 1/30 446/220 |
| 5,098,329 | A * | 3/1992 | Tseng | A63H 27/10 446/221 |
| 5,108,339 | A * | 4/1992 | Kieves | A63H 27/10 446/220 |
| 5,169,353 | A * | 12/1992 | Myers | A63H 3/06 446/221 |
| 5,188,558 | A * | 2/1993 | Barton | A63H 27/10 446/220 |
| 5,282,768 | A * | 2/1994 | Akman | A63H 27/10 446/220 |
| 5,727,270 | A * | 3/1998 | Cope | A47C 27/081 141/114 |
| 6,276,984 | B1 * | 8/2001 | Komaba | A63H 27/10 446/220 |
| 6,318,013 | B1 * | 11/2001 | Cope | A47F 3/14 40/214 |
| 6,634,133 | B1 * | 10/2003 | Levandowski | A01M 31/06 43/2 |
| 6,672,933 | B2 * | 1/2004 | Stanier | A63H 3/06 446/220 |
| 6,758,715 | B2 * | 7/2004 | Banks | A63H 27/10 446/186 |
| 6,866,813 | B1 * | 3/2005 | Trubitt | A63H 3/04 156/229 |
| 6,991,510 | B2 * | 1/2006 | Nan | A47F 8/00 446/220 |
| 2002/0111109 | A1 * | 8/2002 | Kwan | A63H 3/06 446/220 |
| 2003/0102404 | A1 * | 6/2003 | Yabe | G09F 21/06 244/31 |
| 2006/0199466 | A1 * | 9/2006 | Porto | A63H 27/10 446/220 |
| 2007/0161322 | A1 * | 7/2007 | Carmon | A63H 27/10 446/220 |
| 2007/0249259 | A1 * | 10/2007 | Pham | A63H 5/00 446/224 |
| 2014/0273718 | A1 * | 9/2014 | Harris | A63H 27/10 446/222 |

FOREIGN PATENT DOCUMENTS

| | | | |
|---|---|---|---|
| JP | 05084399 | U | 11/1993 |
| JP | 2555456 | Y2 | 11/1997 |
| JP | 11076631 | A | 3/1999 |
| JP | 2013188459 | A | 9/2013 |

OTHER PUBLICATIONS

Japanese Office Action dated Mar. 17, 2015 issued in counterpart Japanese Application No. 2014-209074.

Extended European Search Report dated Jul. 13, 2016, issued in counterpart European Application No. 15828629.4.

* cited by examiner

COUPLED BALLOON

TECHNICAL FIELD

The present invention relates to a coupled balloon configured such that a plurality of film balloons are joined together, and a gas can be injected therein from one valve.

BACKGROUND ART

Typical examples of balloons include vinyl balloons formed from vinyl chloride, film balloons formed from synthetic resin film, and rubber balloons formed from rubber. Printing of characters from manga, anime, and the like, or photographs of dogs, cats, and other animals or of celebrities and other people on the surface of such balloons is a process that is widely carried out. Because film balloons and rubber balloons are relatively light-weight, filling the interior of such balloons with helium gas or the like makes it possible to cause these balloons to float in the air.

As one example of a tool utilizing such balloons, Patent Document 1 below discloses an impact-sound-generating tool in which one or both of at least two pouch bodies, which constitute a set, to be inflated by a gas being blown into the interior thereof are provided with an attaching/detaching implement for detachably connecting and integrating the pouch bodies to each other; Patent Document 1 indicates that the opposing pouch bodies are connected with a bonding agent layer or double-sided bonding tape interposed therebetween as one example of the attaching/detaching implement.

Patent Document 2 below discloses a balloon comprising a plastic film made of polyethylene or the like, the balloon comprising two discoid balloons of the same type, in which the entire periphery of the circular films are welded together, coupled at a circle center or a circle concentric therewith being double-overlapped by bonding or welding, and filled and inflated by air, helium, or the like, the balloon being characterized in that: a coupled part is configured as a heat seal line forming a concentric circle of a given size; a small hole is provided on the inside thereof such that the spaces inside the balloons communicate with each other; a slit is formed in a concentric-circle-shaped heat seal line of the coupled part so as to be set apart from the hole; and a seam in two walls of the balloons extends to the edge of the hole within the concentric circle, to thereby being configured as a blowing inlet having a check valve.

PRIOR ART DOCUMENTS

Patent Documents

[Patent Document 1] Japanese Laid-Open Patent Application No. 2013-188459

[Patent Document 2] Japanese Registered Utility Model No. 2555456

DISCLOSURE OF THE INVENTION

Problems to be Solved by the Invention

Typically, a film balloon is configured from a film in which a heat seal layer comprising polyethylene or another thermo-fusible material is used on the inside, and a gas barrier layer comprising a polyamide, ethylene-vinyl alcohol copolymer resin, or other material exhibiting gas-barrier properties is used on the outside, the film balloon being formed by overlapping the peripheral edge portions of two or three films and performing thermal fusion thereon.

The balloon of Patent Document 2 is configured such that two balloons are coupled by bonding or welding, small holes being provided on the inside thereof so that the spaces inside the balloons are coupled; however, the gas barrier layer on the outside comprising a material exhibiting gas-barrier properties as described above is not readily thermally fused, making it difficult to thermally fuse the balloons together. Even when bonding is used, it is difficult to ensure air-tightness and bond the balloons so that the helium or other gas will not leak, presenting a disadvantage for manufacturing operations as well.

The impact-sound-generating tool of Patent Document 1 is configured such that two pouch bodies, which constitute a set, are connected to each other with a bonding agent layer or double-sided bonding tape interposed therebetween. However, the concept behind this tool does not involve causing the interiors to communicate and injecting a gas from a single location; it is merely that the double-sided bonding tape is used as means for coupling.

As described in Patent Document 2, when two balloons are coupled such that the interiors of the balloons communicate, it is necessary to impart air-tightness so that the helium or other gas will not leak; therefore, a person skilled in the art would be unlikely to consider using double-sided bonding tape or another such material from which only relatively rough bonding can be expected.

Therefore, the objective of the present invention is to provide a coupled balloon in which a plurality of balloons are coupled by a simple method such that the interiors thereof communicate with each other, the coupled balloon being configured such that a gas can be injected into both balloons simultaneously from a single injection inlet.

Means to Solve the Problems

As a result of thoroughgoing investigations intended to achieve the objective described above, the present inventor has surprisingly discovered that it is possible to couple together balloons and impart sufficient air-tightness to withstand the injection of helium gas or the like by joining together the peripheries of through-holes formed in each of the balloons with a double-sided bonding tape interposed therebetween, whereupon the present invention was perfected.

Specifically, the present invention provides a coupled balloon, characterized in comprising: a first balloon body in which the inside comprises a heat seal layer, the outside is formed by overlapping films configured from gas barrier layers, a valve for injecting a gas into one location on the peripheral edge thereof is interposed, and the peripheral edge other than the inner surface of the valve is thermally fused; one or a plurality of second balloon bodies in which the inside comprises a heat seal layer, the outside is formed by overlapping films configured from gas barrier layers, and the peripheral edge thereof is thermally fused; through-holes via which the balloon bodies communicate with each other formed in the first balloon body and in the second balloon body; and a double-sided bonding tape having a communication hole by which the outward-surface-side peripheral edge portions of each of the through-holes are joined together, the communication hole being aligned with the through-holes.

According to the present invention, through-holes via which the balloon bodies communicate with each other are formed in each of the first balloon body and the second balloon body, the outside of the balloon bodies being configured from non-thermo-fusible gas barrier layers, and the outward-surface-side peripheral edge portions of each of the through-holes are joined together by a double-sided bonding tape having a hole that is aligned with the through-holes; therefore, when a gas is injected through the valve in the first balloon body, the gas is further injected into the second balloon body through the through-holes, making it possible to obtain a coupled balloon having a novel shape in which a plurality of balloon bodies are arranged in a coherent and solid three-dimensional shape.

In the embodiments of the present invention, it is preferable for the double-sided bonding tape to comprise synthetic-rubber-based pressure-sensitive adhesive layers formed on both surfaces of a base-material sheet comprising a non-woven fabric, and for the combined thickness of the base-material sheet and the pressure-sensitive adhesive layers to be 100-150 μm.

According to the above embodiment, the outward-surface-side peripheral edge portion of the through-holes of the first balloon body and the outward-surface-side peripheral edge portion of the through-holes of the second balloon body are joined together by relatively thin double-sided bonding tape having exceptional pressure-sensitive adhesive performance, whereby leaking of the injected gas can be more reliably prevented.

Additionally, in the present invention, the inner diameter of the through-holes of the first balloon body and second balloon body is preferably 2-5 mm.

According to the above embodiment, having the inner diameter of the through-holes fall within the range described above makes it possible to more easily seal the peripheral edge portions without raising the air resistance.

Additionally, in the present invention, the inner diameter of the communication hole in the double-sided bonding tape is approximately 0.5-1.0 mm greater than the inner diameter of the through-holes in the first balloon body and second balloon body.

According to the above embodiment, the communication hole can be more easily aligned with the first through-hole and second through-hole, and widening of the bonding surface to be sealed can be minimized.

Additionally, in the present invention, it is preferable for the outer diameter of the double-sided bonding tape to be 20-30 mm, and for the portions of the double-sided bonding tape that surround the through-holes to have a radial-direction width of 9-13 mm.

According to the above embodiment, having the outer diameter and width of the double-sided bonding tape fall within the ranges described above makes it possible to achieve a configuration in which sufficient air-tightness can be ensured.

Additionally, in the present invention, it is preferable not to print on portions of the peripheral edges of the through-holes in the first balloon body and second balloon body at which the double-sided bonding tape is joined.

According to the above embodiment, using the double-sided bonding tape to join together non-printed surfaces makes it possible to further optimize the air-tightness of the joined surfaces.

Advantageous Effects of the Invention

According to the present invention, a relatively simple method, in which the periphery of the through-holes in each of the balloons are joined together with the double-sided bonding tape interposed therebetween, makes it possible to obtain a coupled balloon in which a gas is injected into the second balloon body through the through-holes when the gas is injected through the valve in the first balloon body. Such a coupled balloon makes it possible to couple a second balloon body having the shape of, e.g., a ribbon, eye, or ear to a first balloon body having the shape of an animal or doll, and to provide a balloon toy having a novel shape by which a three-dimensional solidity is expressed.

BEST MODE FOR CARRYING OUT THE INVENTION

Embodiments of the coupled balloon of the present invention will be described below with reference to the drawings. FIGS. 1-5 show one embodiment of the coupled balloon according to the present invention.

Figure 1:
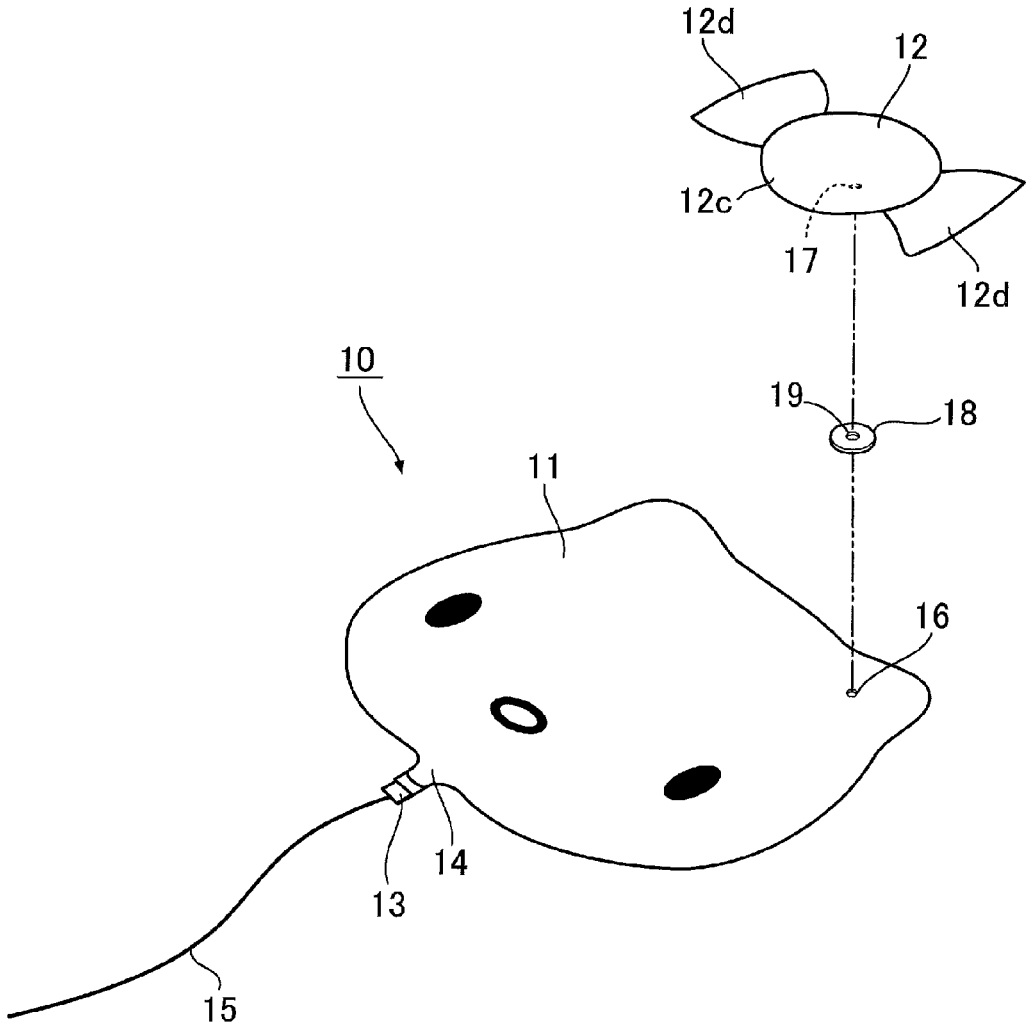
FIG. 1 is an exploded perspective view of one embodiment of a coupled balloon of the present invention.
Figure 3:
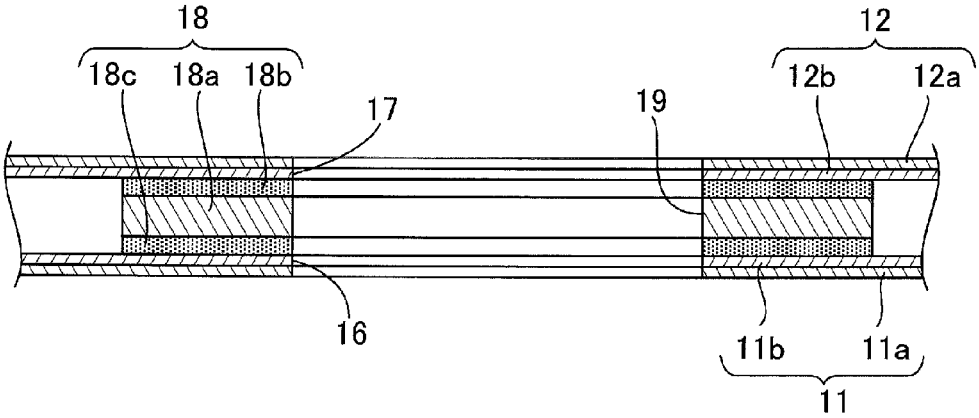
FIG. 3 is a partial cross-sectional view of an art for the coupled part of the coupled balloon shown in FIG. 1.

As shown in FIG. 1, a coupled balloon 10 is formed from a first balloon body 11 and a second balloon body 12. The films constituting the first balloon body 11 and second balloon body 12 are configured such that the insides are formed from heat seal layers 11*a*, 12*a* and the outsides are formed from gas barrier layers 11*b*, 12*b*, as shown in FIG. 3.

The heat seal layers 11*a*, 12*a* comprise thermo-fusible resin layers; for example, polyethylene, polypropylene, or the like is preferably used. The gas barrier layers 11*b*, 12*b* comprise layers that are exceptionally impermeable to helium and other gasses; examples of the material for this layer include: polyamide, ethylene-vinyl alcohol copolymer resins, polyethylene terephthalate, and other gas-impermeable synthetic resin films; vapor-deposited layers of metal or inorganic-acid compounds formed on synthetic resin films; and metal foils layered on synthetic resin films, where it is particularly preferable to use polyamide or ethylene-vinyl alcohol copolymer resins.

The first balloon body 11 and the second balloon body 12 are formed by overlapping two films as described above, with the heat seal layers 11*a*, 12*a* on the inside, and performing thermal fusion on the peripheral edges thereof. The first balloon body 11 has an air injection section 14 at one location on the peripheral edge; a check valve 13 is sandwiched between the films at the air injection section 14, and the check valve 13 is integrally welded (see FIG. 1). The check valve 13 is well-known, as described in, e.g., U.S. Pat. No. 4,612,639; therefore, no specific description thereof is given here. In the present embodiment, a string body 15 is connected to the air injection section 14, a configuration being adopted in which the string body 15 can be held by hand when the balloon is inflated and floating. In the present embodiment, the first balloon body 11 has a shape representing an animal, specifically a cat.

The second balloon body 12 has a circular portion 12*c*, and semicircular portions 12*d* each coupled with a portion toward the periphery of the circular portion 12*c*. The outer periphery of the circular portion 12*c* is thermally fused, an air-tight space being formed in the interior thereof. Of the semicircular portion 12*d*, only the arcuate portion is thermally fused, and the interior and a linear portion are open; the semicircular portion 12*d* is configured so as to spread in the form of a frill when a gas is injected into the interior of the circular portion 12*c*.

Figure 2:
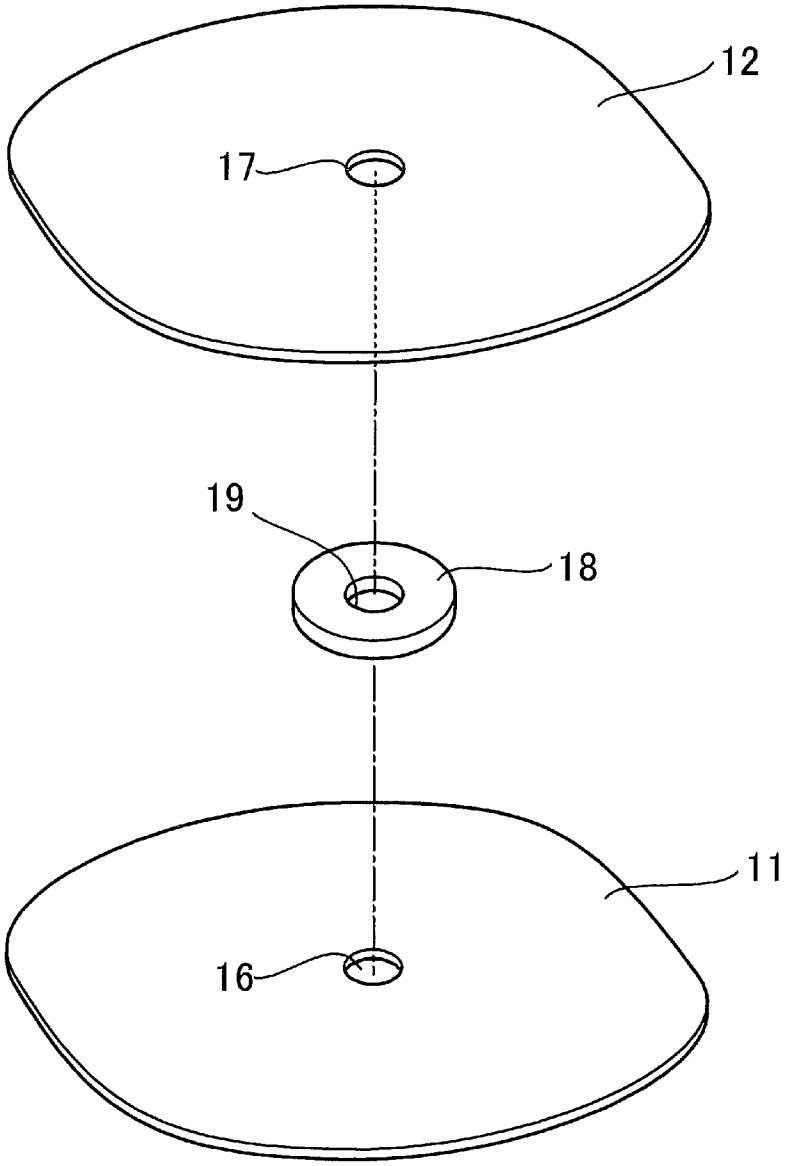
FIG. 2 is a partial enlarged perspective view of a coupled part of the coupled balloon shown in FIG. 1.

A first through-hole 16 is formed in the first balloon body 11, and a second through-hole 17 is formed in the second balloon body 12. As shown in FIG. 2, the first balloon body 11 and the second balloon body 12 are configured so as to be joined together with a double-sided bonding tape 18 interposed therebetween, such that the first through-hole 16 and the second through-hole 17 are aligned. A communication hole 19 arranged so as to encompass the first through-hole 16 and second through-hole 17 is formed in the double-sided bonding tape 18. A configuration is adopted in which the first balloon body 11 and the second balloon body 12 are in communication with each other through the first through-hole 16, the communication hole 19, and the second through-hole 17.

FIG. 3 is an enlarged cross-sectional view of the coupling part. As described above, in the film constituting the first balloon body 11, the inside comprises a heat seal layer 11*a*, and the outside comprises a gas barrier layer 11*b*; in the film constituting the second balloon body 12, the inside comprises a heat seal layer 12*a*, and the outside comprises a gas barrier layer 12*b*. The gas barrier layers 11*b*, 12*b* both comprise materials that are not readily thermally fused; however, these layers 11*b*, 12*b* can be bonded by the double-sided bonding tape 18.

In the present embodiment, the double-sided bonding tape 18 is configured from a non-woven fabric 18*a*, and pressure-sensitive adhesive layers 18*b*, 18*c* formed on both surfaces thereof. In this case, the thickness of the double-sided bonding tape 18 (the total thickness of the non-woven fabric 18*a*, the pressure-sensitive adhesive layer 18*b*, and the pressure-sensitive adhesive layer 18*c*) is preferably 100-150 μm, and more preferably 130-140 μm. When the thickness is less than 100 μm, it could be impossible to obtain sufficient bonding strength or air-tightness; conversely, when the thickness exceeds 150 μm, it could be difficult to ensure air-tightness.

Figure 4:
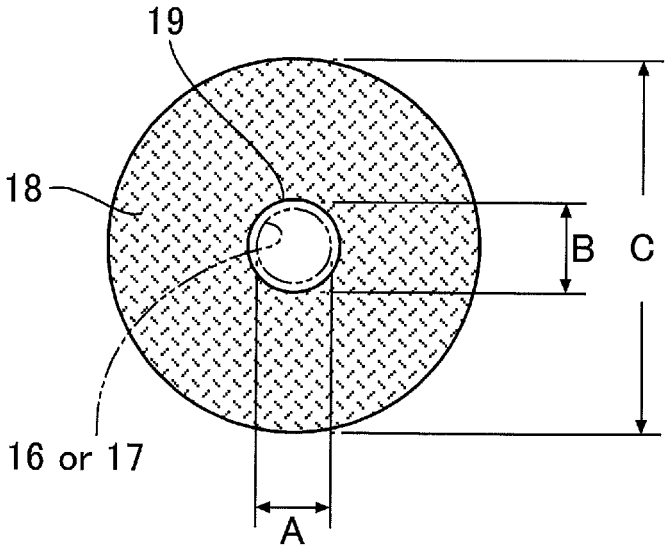
FIG. 4 is a plan view of a double-sided bonding tape of the coupled balloon shown in FIG. 1.

FIG. 4 is a plan view of the double-sided bonding tape 18. The shapes of the first through-hole 16 and second through-hole 17 are indicated by the phantom lines inside the communication hole 19. The inner diameter A of the first through-hole 16 and second through-hole 17 is preferably 2-5 mm, and more preferably 2-3 mm. When the inner diameter of the first through-hole 16 and second through-hole 17 is less than 2 mm, the resistance of air to be communicated could increase; conversely, when the inner diameter exceeds 5 mm, the outer peripheries could be difficult to join together with sufficient air-tightness.

The inner diameter B of the communication hole 19 is preferably approximately 0.5-1.0 mm greater than the inner diameter A of the first through-hole 16 and second through-hole 17. When the inner diameter B of the communication hole 19 is too little, it is more difficult to align the communication hole 19 with the first through-hole 16 and second through-hole 17; conversely, when the inner diameter B is too great, the bonding surface to be sealed widens, and sealing defects more readily occur.

Furthermore, the outer diameter C of the double-sided bonding tape 18 is preferably 20-30 mm, and more preferably 24-26 mm. The radial-direction width of the double-sided bonding tape 18 ((C−B)×½) is preferably 9-13 mm, and more preferably 10-12 mm. Setting the radial-direction width of the double-sided bonding tape 18 within the range described above makes it possible to facilitate bonding to the periphery of the first through-hole 16 and second through-hole 17 with sufficient air-tightness.

It is preferable that no printing is carrying out on portions of the periphery of the first through-hole 16 and second through-hole 17 to which the double-sided bonding tape 18 is bonded. When printing is carried out on these portions, unevenness of the printed surface could make it easier for gaps to form between the printed surface and the double-sided bonding tape 18, and reduce air-tightness.

Figure 5:
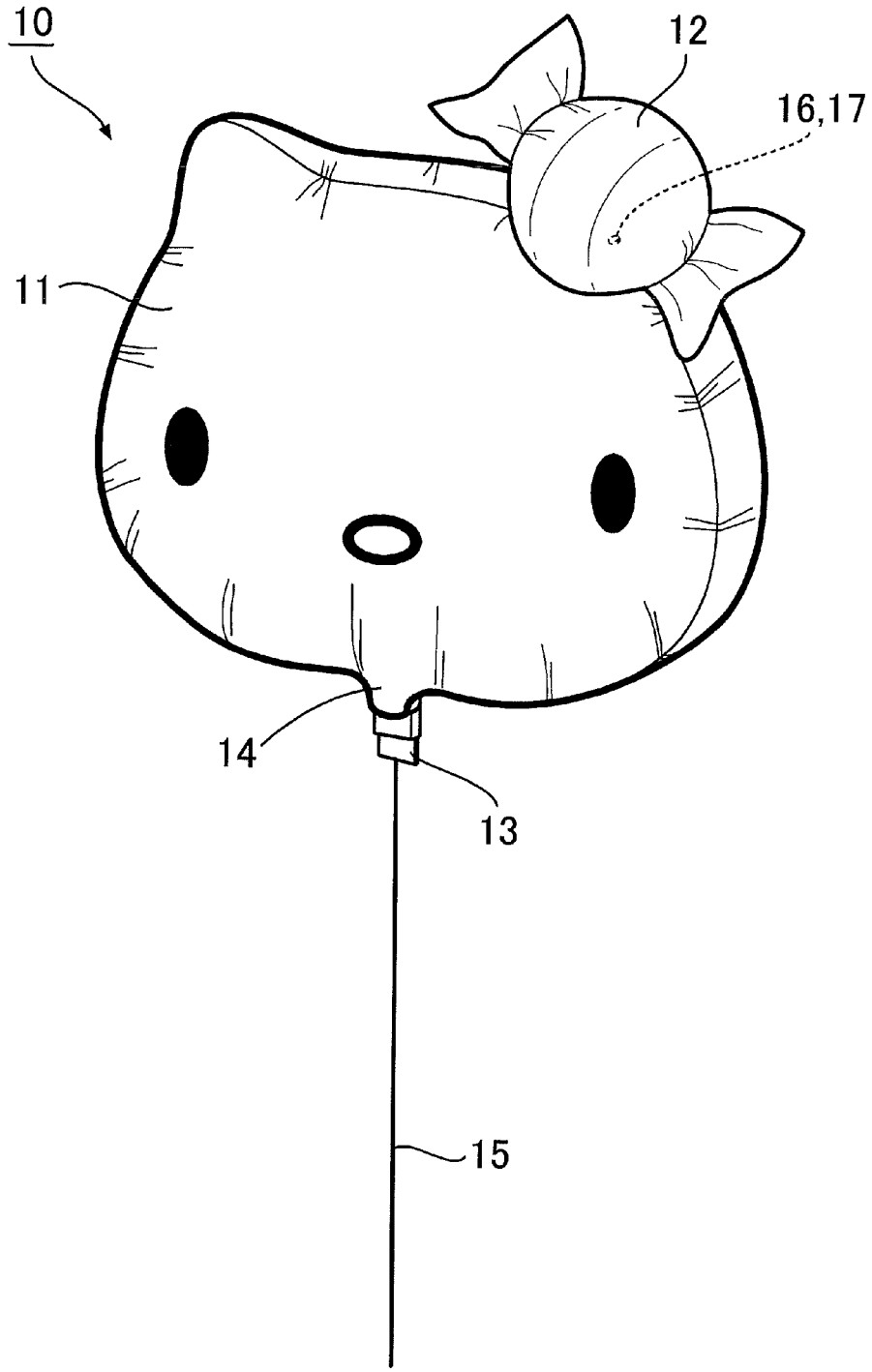
FIG. 5 is a perspective view of the coupled balloon shown in FIG. 1, the coupled balloon being in an inflated state.

In the coupled balloon 10 of the present invention, the nozzle of a gas canister, a straw, or the like is inserted from the check valve 13, and helium gas, air, or another gas is injected, whereby the gas can be injected into the interior of the first balloon body 11, while also being injected into the interior of the second balloon body 12 through the first through-hole 16, the communication hole 19, and the second through-hole 17. In this manner, the gas fills the interiors of both the first balloon body 11 and the second balloon body 12, making it possible to form a balloon toy as shown in FIG. 5. This balloon toy comprises the coupled balloon 10 configured from the first balloon body 11 having the shape representing an animal face (in this case, a cat) and the second balloon body 12 having the shape representing a ribbon, the second balloon body 12 being coupled with a head portion of the first balloon body 11. The second balloon body 12 is arranged in a solid three-dimensional shape, forming a novel shape coupled to the first balloon body 11.

Figure 6:
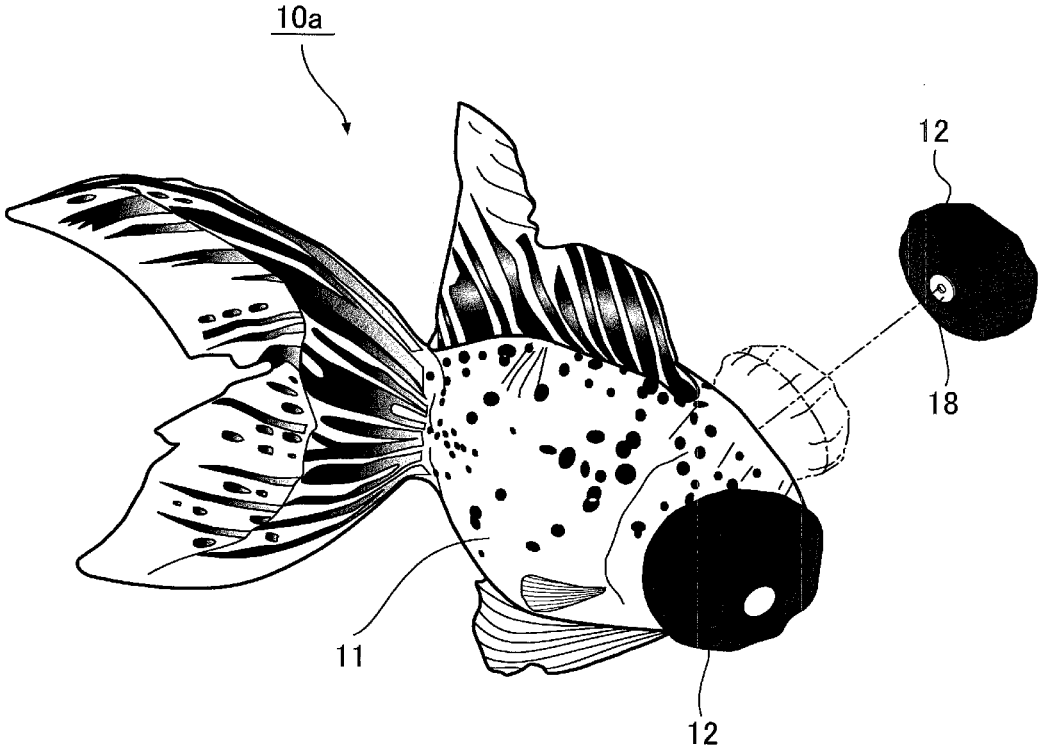
FIG. 6 is a perspective view of another embodiment of the coupled balloon of the present invention, the coupled balloon being in an inflated state.

FIG. 6 shows another embodiment of the coupled balloon of the present invention.

The coupled balloon 10*a* is configured from a first balloon body 11 having the shape representing a goldfish, and two second balloon bodies 12 having the shape representing eyes. The first balloon body 11 is formed by welding the peripheral edge portions of three films, including a left-side surface, a right-side surface, and a ventral surface. Through-holes (not shown) are formed in the first balloon body 11 and second balloon bodies 12, and the peripheries thereof are bonded by a double-sided bonding tape 18, whereby the second balloon bodies 12 are coupled with the first balloon body 11. Additionally, a valve (not shown) is attached to the first balloon body 11. When helium gas, air, or another gas is injected into the first balloon body 11 through the valve, the gas is further injected into the second balloon bodies 12 through the through-holes, making it possible to configure a balloon toy in the shape of a goldfish as shown in FIG. 6. In this balloon toy, the second balloon bodies 12 having the shape of goldfish eyes are arranged in a solid three-dimensional shape, forming a novel shape coupled with the first balloon body 11.

EXPLANATION OF NUMERALS AND CHARACTERS

10, 10*a* Coupled balloon
11 First balloon body
11*a* Heat seal layer
11*b* Gas barrier layer
12 Second balloon body
12*a* Heat seal layer
12*b* Gas barrier layer

12*c* Circular portion
12*d* Semicircular portion
13 Check valve
14 Air injection section
15 String body
16 First through-hole
17 Second through-hole
18 Double-sided bonding tape
18*a* Non-woven fabric
18*b*, 18*c* Pressure-sensitive adhesive layer
19 Communication hole
A Inner diameter of through-hole
B Inner diameter of communication hole
C Outer diameter of double-sided bonding tape

The invention claimed is:

1. A coupled balloon comprising:

a first balloon body in which an inside thereof comprises a heat seal layer, an outside thereof is formed by overlapping films configured from gas barrier layers, a valve for injecting a gas into one location on a peripheral edge thereof is interposed, and the peripheral edge other than an inner surface of the valve is thermally fused;

at least one second balloon body in which an inside thereof comprises a heat seal layer, an outside thereof is formed by overlapping films configured from gas barrier layers, and a peripheral edge thereof is thermally fused;

through-holes via which the first balloon body and the at least one second balloon body communicate with each other formed in the first balloon body and in the at least one second balloon body; and a double-sided bonding tape comprising a communication hole by which outward-surface-side peripheral edge portions of each of the through-holes are joined together, the communication hole being aligned with the through-holes.

2. The coupled balloon as in claim 1, wherein the double-sided bonding tape comprises synthetic-rubber-based pressure-sensitive adhesive layers formed on both surfaces of a base-material sheet comprising a non-woven fabric; and a combined thickness of the base-material sheet and the pressure-sensitive adhesive layers is 100-150 μm.

3. The coupled balloon as in claim 1, wherein an inner diameter of the through-holes in the first balloon body and the at least one second balloon body is 2-5 mm.

4. The coupled balloon as in claim 3, wherein an inner diameter of the communication hole in the double-sided bonding tape is approximately 0.5-1.0 mm greater than the inner diameter of the through-holes in the first balloon body and the at least one second balloon body.

5. The coupled balloon as in claim 1, wherein an outer diameter of the double-sided bonding tape is 20-30 mm, and portions of the double-sided bonding tape that surround the through-holes have a radial-direction width of 9-13 mm.

6. The coupled balloon as in claim 4, wherein an outer diameter of the double-sided bonding tape is 20-30 mm, and portions of the double-sided bonding tape that surround the through-holes have a radial-direction width of 9-13 mm.

7. The coupled balloon as in claim 1, wherein no printing is carried out on portions of peripheral edges of the through-holes in the first balloon body and the at least one second balloon body at which the double-sided bonding tape is joined.

8. The coupled balloon as in claim 2, wherein no printing is carried out on portions of peripheral edges of the through-holes in the first balloon body and the at least one second balloon body at which the double-sided bonding tape is joined.

9. The coupled balloon as in claim 5, wherein no printing is carried out on portions of peripheral edges of the through-holes in the first balloon body and the at least one second balloon body at which the double-sided bonding tape is joined.

10. The coupled balloon as in claim 6, wherein no printing is carried out on portions of peripheral edges of the through-holes in the first balloon body and the at least one second balloon body at which the double-sided bonding tape is joined.

11. The coupled balloon as in claim 2, wherein:

an inner diameter of the through-holes in the first balloon body and the at least one second balloon body is 2-5 mm;

an inner diameter of the communication hole in the double-sided bonding tape is approximately 0.5-1.0 mm greater than the inner diameter of the through-holes in the first balloon body and the at least one second balloon body;

an outer diameter of the double-sided bonding tape is 20-30 mm, and portions of the double-sided bonding tape that surround the through-holes have a radial-direction width of 9-13 mm; and no printing is carried out on portions of peripheral edges of the through-holes in the first balloon body and the at least one second balloon body at which the double-sided bonding tape is joined.

* * * * *